United States Patent [19]

Giocastro et al.

[11] Patent Number: 4,556,023

[45] Date of Patent: Dec. 3, 1985

[54] ROTARY VALVES AND GEAR TIMING

[76] Inventors: Joseph Giocastro, 6428 Metropolitan Ave., Middle Village; Salvatore Giocastro, 5311 73th St., Maspeth; James Giocastro, 6428 Metropolitan Ave., Middle Village, all of N.Y. 11379

[21] Appl. No.: 519,105

[22] Filed: Aug. 2, 1983

[51] Int. Cl.[4] ..... F01L 7/00

[52] U.S. Cl. ..... 123/190 A; 123/190 C; 123/190 DL

[58] Field of Search ..... 123/80 BA, 190 A, 190 R, 123/190 C, 190 DL, 190 E, 190 CA, 80 C, 41.82 R, 41.82 A, 85

[56] References Cited

U.S. PATENT DOCUMENTS

| | | | |
|---|---|---|---|
| 1,098,411 | 6/1914 | Schmidt | 123/190 A |
| 1,112,523 | 10/1914 | Clark | 123/80 BA |
| 1,130,045 | 3/1915 | Walker | 123/80 BA |
| 1,171,834 | 2/1916 | Brower | 123/80 BA |
| 1,191,684 | 7/1916 | Fountain | 123/80 BA |
| 1,213,536 | 1/1917 | Quelle | 123/190 A |
| 1,513,911 | 11/1924 | Keller | 123/190 A |
| 2,730,088 | 1/1956 | Hyde | 123/80 BA |
| 3,171,425 | 3/1965 | Berlyn | 123/190 A |
| 3,896,781 | 7/1975 | Smith | 123/190 A |

*Primary Examiner*—Ronald H. Lazarus

*Attorney, Agent, or Firm*—Lackenbach Siegel Marzullo Presta & Aronson

[57] ABSTRACT

A pair of rotary valves for an internal combustion engine positioned in a cylinder head over a cylinder block. The rotary valves include a pair of rotatable shafts, and a pair of sleeve supports having ports opening to the cylinder or cylinders of the engine. The pair of rotatable shafts can be either hollow or solid. The hollow intake shaft brings in a fuel mixture to an inlet passage that rotates into alignment with an intake opening in the intake shaft to the piston cylinder. The hollow exhaust shaft allows exhaust of burned gases from the piston chamber through an exhaust opening from the piston cylinder to an exhaust passage in the exhaust shaft and to the atmosphere. The solid rotatable shafts are provided with a diametrical intake channel and a diametrical exhaust channel that aligns with the openings to the piston cylinder and to the fuel mixture and to the atmosphere. Drive and timing gearing between the crankshaft and the intake and exhaust shafts are provided.

4 Claims, 17 Drawing Figures

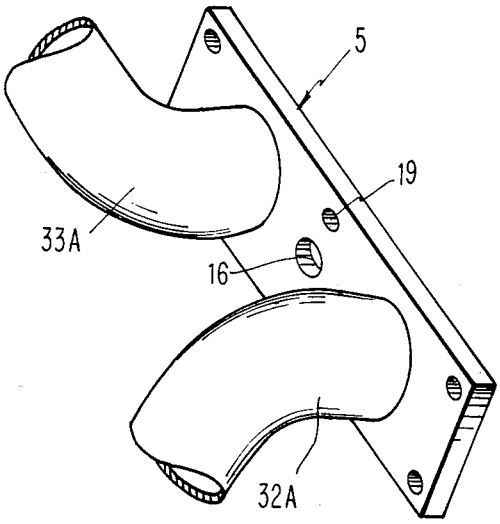
FIG. 5
FIG. 6
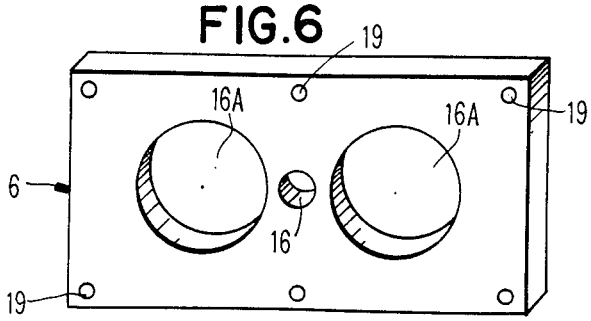
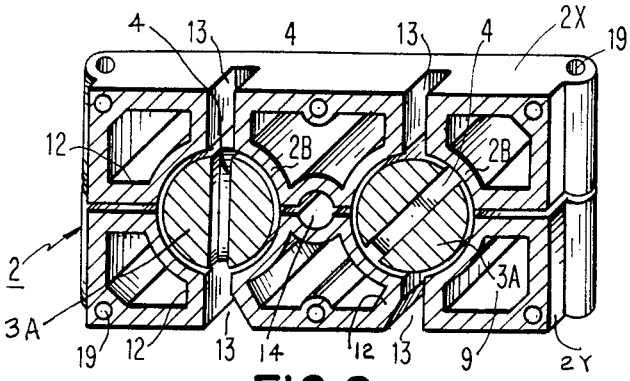
FIG. 8
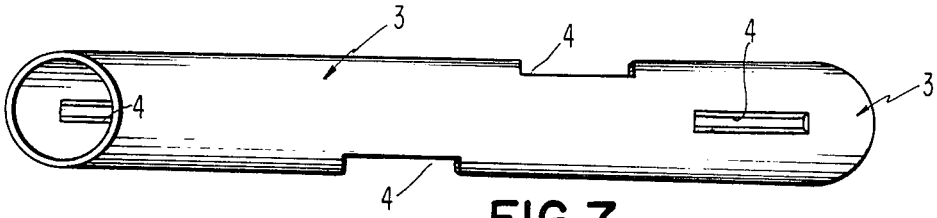
FIG. 7
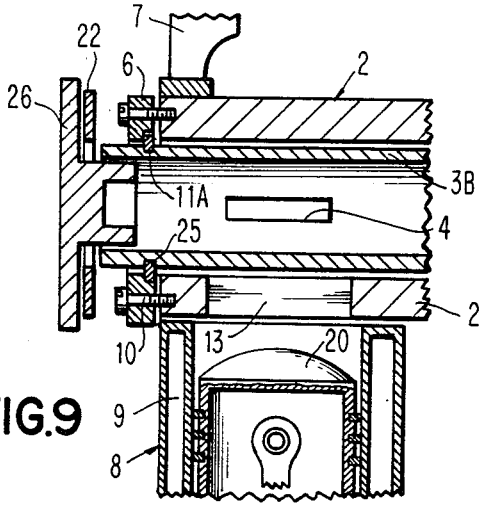
FIG. 9
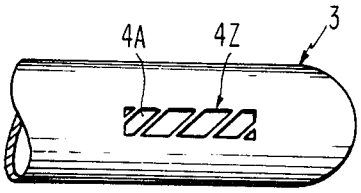
FIG. 10
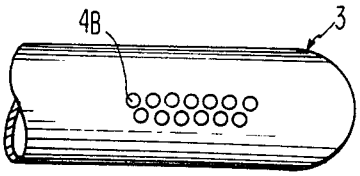
FIG. 11
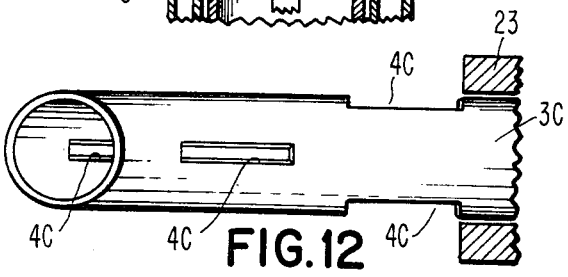
FIG. 12
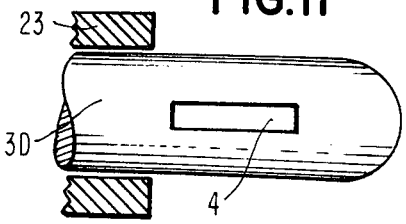
FIG. 13

ROTARY VALVES AND GEAR TIMING

This invention relates to engines and more particularly to a camshaft insert positioned in a head cylinder with a gear train timer attached to the hollow camshaft.

Poppet valves that open and close the cylinder chamber for gases and intake of fresh air and exhaust of burned gases are separate elements that can malfunction for any number of reasons.

An object of my invention is to provide a cylindrical valve enclosing a pair of rotatably mounted camshafts with a gear train for supplying a fuel mixture to an exhausting burned gases from the cylinders of an engine.

Another object of my invention is to provide a pair of hollow camshafts rotatably mounted in a pair of cylindrical valves, the hollow camshafts having eccentrically positioned openings in accordance with the operating cycle of the engine wherein each opening is opened once every other revolution of the crankshaft so that the camshaft is geared to run at half the speed of the crankshaft and the opening is adapted to open long enough to obtain the most efficient filling and emptying of the engine cylinders.

Another object of my invention is to provide a rotatable hollow shaft within a journalled sleeve having openings adapted to align over the openings in the head of the cylinders.

Another object of my invention is a solid metal camshaft having a diametrical opening that leads from each cylinder to either the inlet or outlet.

BRIEF DESCRIPTION OF THE DRAWINGS

FIG. 5 is a perspective view of an end sealing cover of the head containing cooling water;

FIG. 6 is a perspective view of an end sealing cover;

FIG. 7 is a perspective view of the hollow camshaft having openings for registering with a four-cylinder engine;

FIG. 8 is a perspective sectional view illustrating a modified form of the head and showing a pair of solid cylindrical camshafts rotatably mounted in the valve sleeves;

FIG. 9 is a modified form of the invention as shown in FIG. 1 having a snap ring;

FIG. 10 is a modified form of the invention as shown in FIG. 7 with the camshaft having a ribbed configuration;

FIG. 11 is another modified form of the invention as shown in FIG. 7 with the camshaft having holes;

FIG. 12 is a perspective view of a hollow camshaft adapted to operate at half the crankshaft speed;

FIG. 13 is a perspective view of a modified solid camshaft adapted to operate at one-fourth the crankshaft speed;

DETAILED DESCRIPTION OF THE INVENTION

Reference is made in detail to the drawings.

Figure 1:
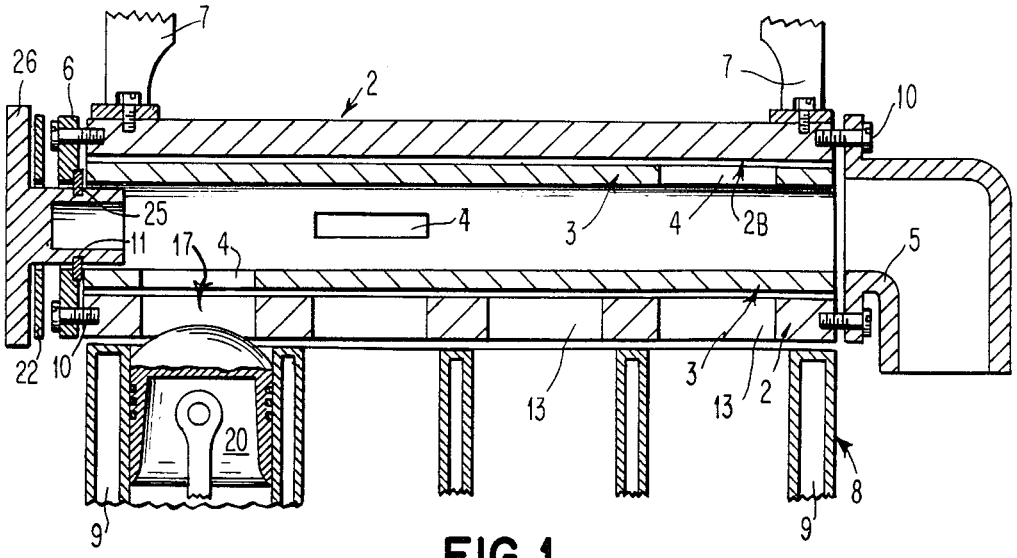
FIG. 1 is a diagrammatic sectional side view of the present invention that illustrates an embodiment of a hollow camshaft positioned in a horizontal cylindrical valve disposed over the cylinders of an engine including timing gearing.

FIG. 1 illustrates a cylinder head 2 of a four cylinder internal combustion engine. Head 2 has four ports, or openings, 13 aligned with four pistons 20.

A hollow cylindrical camshaft 3 has ports, or openings, 4 adapted to register with openings 13 of head 2. Camshaft 3 of FIG. 1 is typical of either a cylindrical fuel mixture intake valve 33 or a cylindrical burned fuel exhaust valve 33 that are positioned alongside one another as seen in FIGS. 2, 3, 4, and 8. When openings 4 and 13 are in registry, a complete passage 17 is formed so that an intake fuel mixture can be drawn into the particular cylinder to be ignited by a spark plug 18 (seen in FIG. 3), or burned gases exhausted in accordance with the function of the particular camshaft. Thus, openings 4 and 13, with the help of timing gear and a piston 20, control the exhaust and intake to and from cylinder block 8 of the engine. Hollow camshaft 3, representing both inlet and exhaust camshafts, rotates in a head cylinder sleeve 2B, also seen in FIG. 2. Camshaft 3, acting as an inlet and outlet manifold, fits precisely into sleeve 2B and rotatably rides on the inner face of sleeve 2B with the necessary aid clearance. A snap ring 11 is positioned under cover 6 in a groove 11A cut in the outer surface of a cylindrical extension of a timing hub 26 disposed near cover 6.

Figure 2:
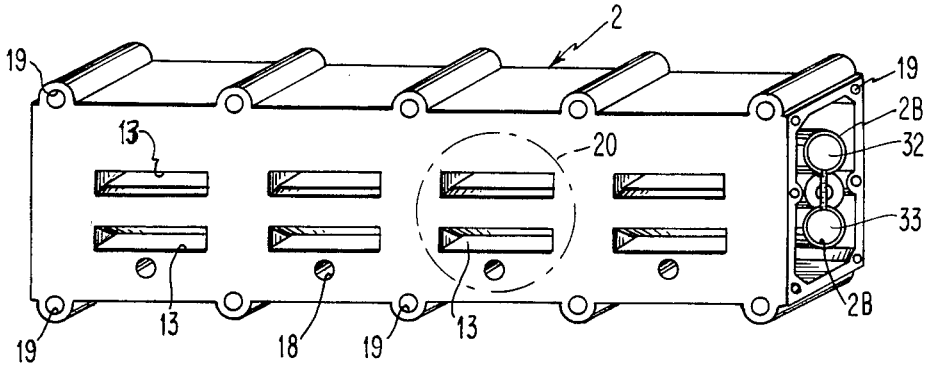
FIG. 2 is a perspective view of a preferred embodiment of the present invention including views of paired hollow horizontal intake and exhaust cylindrical valve sleeves.

FIG. 2, which shows the bottom side of head 2, schematically indicates the striking face of piston 27. Hollow camshaft 3 is rotated once in response to two rotations of the crankshaft. Cylinder block 8 forms a water jacket 9 to cool the pistons. Bolts 10 hold covers 5 and 6 to head 2.

Figure 3:
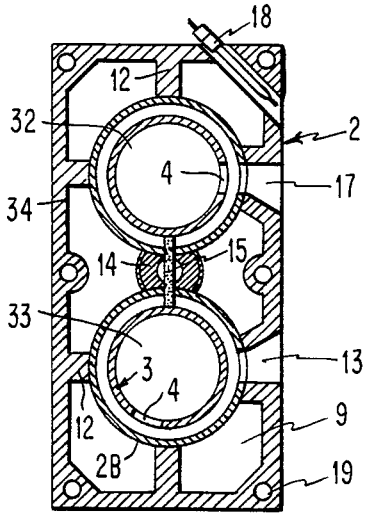
FIG. 3 is a sectional view of the pair of hollow intake and exhaust cylindrical valves supported by ribs within a head.

FIG. 3 shows an embodiment of head 2 with ribs 12 extending outwardly from each sleeve 2B to an outer wall 34 that completely encloses sleeves 2B. Ribs 12 reinforce head 2 and prevent warping of sleeves 2B and head warping in general. Oil felt 15 positioned between sleeves 2B lubricates the rubbing of surfaces of sleeves 2B and camshaft 3.

Figure 4:
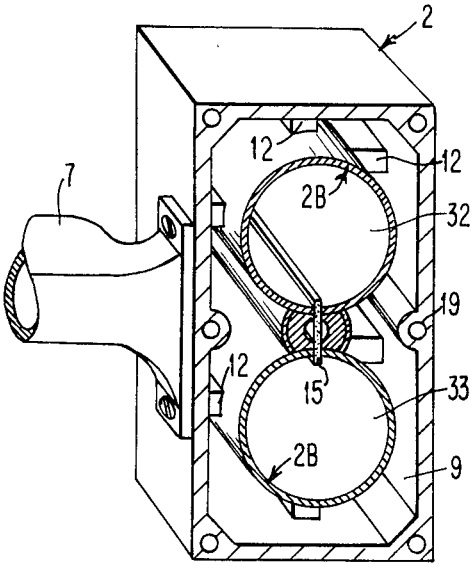
FIG. 4 is a perspective sectional view of the pair of hollow intake and exhaust cylindrical valves supported in a water-cooled head.

FIG. 4 shows a modification of the rib construction of FIG. 3 with ½0 inch cutaways for all ribs 12 at the joining portions of head 2 for the purpose of circulating water through a water jacket 9A. A connector 7 secured to head 2 circulates water in and out of head 2 and water jacket 9A.

FIG. 2 shows bolt holes 19 that extend upwardly along outer walls 35 of head 2 for securing head 2 to cylinder block 8.

FIG. 5 shows an end cover 5 with lead-in lines 32A and 33A of inlet and outlet valves 32 and 33 respectively for head 2. An oil supply hole 16 is shown between inlet and outlet valves 32 and 33.

Rotating camshafts 3 go through head sleeves 2B to cover 5. The openings 16A in cover 5 seen in FIG. 6 on the intake and exhaust valves 32 and 33 are slightly smaller than sleeves 2B to keep the camshafts in line with camshaft sleeves 2B.

FIG. 6 shows a cover 6 adapted to fit over the end of the embodiment shown in FIG. 9, which includes a snap ring 1 snapped into a circular groove 11 of a timing gear hub 26 secured to camshaft 3. Cover 6 secures snap ring 1 and timing gear hub 26 so that end to end clearance of camshaft 3 is maintained.

FIG. 7 illustrates a hollow camshaft 3 having four openings 4 aligned for a four cylinder engine. A pair of hollow camshafts 3 will be positioned in sleeves 2B and will be rotated by means of precisely timed gearing so that intake of a fuel mixture and exhaust of the burned gases are most efficiently accomplished. Camshaft 3 in FIG. 7 is rotatably mounted with bronze bearings 23 disposed between the camshaft and a sleeve 2B.

FIG. 8 illustrates a head 2A having ribs 12 similar to those shown in FIG. 3. Head 2 here is made in two pieces, an upper head portion, or cap, 2X, and a lower head portion, 2Y. Inlet and outlet valves 32 and 33 include a pair of cylindrical sleeves 2B and a pair of solid camshafts 3A rotatably mounted in sleeves 2B. Here, openings 4 extend diametrically across solid camshafts 3A to two pair of opposed openings 13 in head 2A that connect a piston with intake or exhaust tubes depending on the position of openings 4. Bolt holes 19 are adapted to receive bolts for mounting to a cylinder block such as cylinder block 8 shown in FIG. 1. Solid camshaft 3A rotates once in response to four rotations of the crankshaft; that is, for every two turns of the crankshaft per firing of the piston, one-half a rotation of the camshaft occurs.

FIG. 9 shows a head 2 that is a modification of the head shown in FIG. 1. Here, a hollow camshaft 3B is slightly longer than camshaft 3 in FIG. 1 in order that a snap ring 11 for providing end to end clearance and rigid securance for camshaft 3B is mounted around camshaft 3B under cover 6 in a hollow groove 11A cut around the periphery near the end of hollow camshaft 3B. (See the discussion above with reference to FIG. 1 where groove 11A is cut from a cylindrical mount extending from the inner side of hub 26.) Camshaft 33 rotates in cylinder head 2. One end of camshaft 3B goes to cover 5 (not shown) and the other end goes through cover 6 so that gearing may be secured to camshaft 3B. Cylinder block 8 forms a water jacket 9.

FIG. 10 is a modification of hollow camshaft 3A of FIG. 7. Here, opening 4Z has bars, or ribs, to achieve greater strength and rigidity when camshaft 3A is constructed of lightweight material. Ribbed opening 4A is capable of being precisely aligned with an opening 13 of head 2 shown in FIG. 1.

FIG. 11 shows another modification of hollow camshaft 3A of FIG. 7. Here, opening 4B has a plurality of small holes to achieve greater strength and rigidity when hollow camshaft 3A is constructed of lightweight material. Opening 4B is capable of being precisely aligned with opening 13 of head 2 shown in FIG. 1.

FIG. 12 shows a modified hollow camshaft 3C similar to camshaft 3C of FIGS. 1 and 7 having eccentrically positioned openings 4C so that every half turn of hollow camshaft 3C will register with a head opening 13 for a piston for every two turns of crankshaft, which is a 4 to 1 crankshaft to camshaft ratio for each piston firing. Bearings 23 are shown positioned around camshaft 3C to aid in the rotatability of camshaft 3C in sleeve 2B of head 2.

FIG. 13 illustrates a modified solid steel camshaft 3D similar to solid camshaft 3A shown in FIG. 8. Camshaft 3C has openings 4 that are adapted to register every half-turn of camshaft 3C to every two turns of the crankshaft so that a 4 to 1 crankshaft to camshaft ratio is obtained; that is, for every firing of the piston, or two turns of the crankshaft, one-half a turn of the camshaft occurs.

Figure 15:
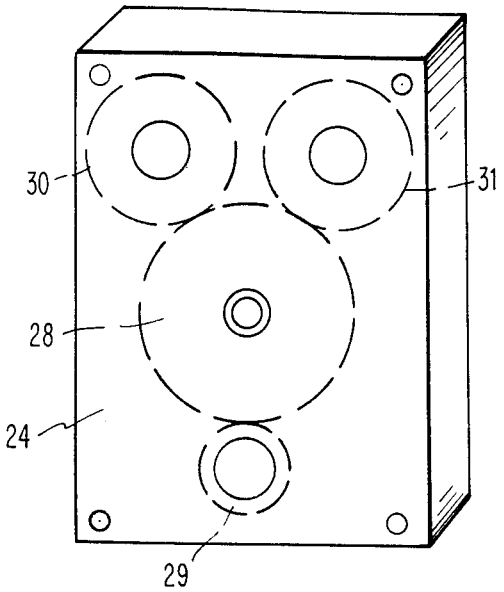
FIG. 15 is a diagrammatic view of a timing gear train for the paired intake and exhaust cylindrical valves.

Attention is now again directed to FIG. 8 where the 4 to 1 crankshaft to camshaft turning ratio is operable by way of a timing gear train 24 mounted in a gearbox shown in FIG. 15 that regulates camshafts 3A and their openings 4 with the pair of lower head openings 13 and the pair of upper head openings 13 of head 2A so as to achieve the required four to one crankshaft to camshaft turning ratio. Gear train 24 includes large central idler gear 38, bottom crankshaft gear 29 and paired top camshaft gears 30 and 31. Crankshaft gear 29 drives large idler gear 28 which is sized so as to drive camshaft gears 30 and 31 at the required four to one turning ratio.

Figure 14:
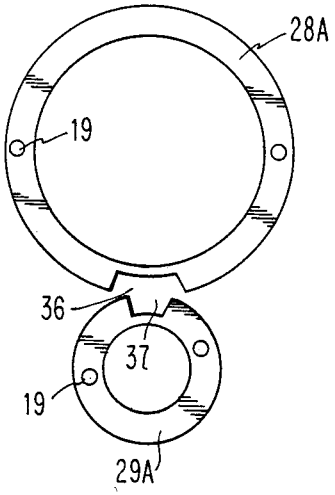
FIG. 14 is a sectional end view of a shield and key for mounting the meshing gears.
Figure 17:
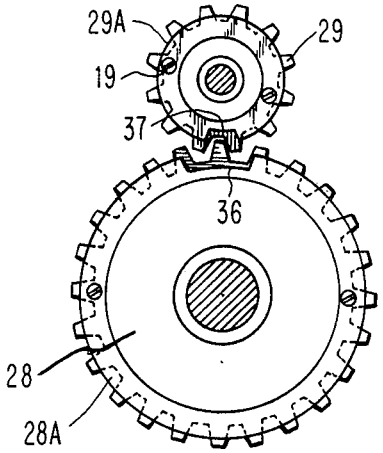
FIG. 17 is an end view of a portion of the gear train shown in FIG. 15.

FIGS. 14 and 17 illustrate idler gear 28 and crankshaft gear 29 meshed in operable relationship. Idler gear 28 is provided with a shield 28A and camshaft gear 29 is provided with a shield 29A. Both shields are provided with bolt holes 19, which in turn are aligned with bolt holes (not shown) provided in gears 28 and 29. Keyways 36 and 37 provided for shields 28A and 29A respectively leave the teeth of their respective, gears open for meshing.

The normal rims of shields 28A and 29A block off meshing with the mated gear so that the two gears can be meshed only at the keyways. This enables a mechanic to align the gears quickly and correctly during maintenance or repair operations. It is possible to make the gear and the shield as a single unit.

Figure 16:
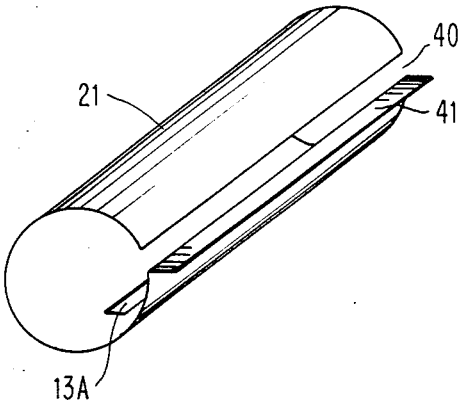
FIG. 16 is a perspective view of a sleeve for each camshaft.

FIG. 16 illustrates a removable steel sleeve 21 having a lengthwise opening 40 with a lip 41 and forming openings 13A adapted to register with head openings 13. Lip 41 is adapted to slide into a groove (not shown) in head 2 so as to rigidly secure sleeve 21 with the head. Camshafts 3 ride on the inner face of sleeve 21. As sleeve 21 becomes worn, it can be easily replaced. Oil clearance between the sleeve and the camshaft is also better controlled since the units can be replaced at the same time.

It is to be understood that the invention particularly described herein is not to be considered limited to the details set forth above, but that if various modifications and changes of the embodiments described occur to those skilled in the art, these are to be regarded as within the scope of the invention as defined by the appended claims.

What I claim is:

1. A rotary valve system for an internal combustion engine, comprising, in combination, a cylinder block forming at least one cylinder for a piston, said block forming paired intake and exhaust openings to said cylinder, a crankshaft connected to said piston, a cylinder head member positioned over said cylinder block, a source of fuel mixture, a first cylinder sleeve positioned within and connected to said head member forming intake port means for passing said fuel mixture to said intake opening of said cylinder.

a second cylindrical sleeve positioned in and connected to said head member parallel with said first sleeve forming exhaust port means for passing burned gases from said exhaust opening of said cylinder to the atmosphere, first shaft means rotatably positioned in said first sleeve, said first shaft means forming intake passage means capable of being aligned with said intake opening to said cylinder and said intake port means of said first sleeve wherein said fuel mixture is passed through said intake port means, said intake passage means, and said intake opening to said cylinder.

second shaft means rotatably positioned in said second sleeve, said second shaft forming exhaust passage means capable of being aligned with said exhaust opening to said cylinder and said exhaust port means of said second sleeve wherein exhaust gases are passed from said cylinder through said exhaust opening, said exhaust passage means, and said exhaust port means to the atmosphere, drive means connected to said crankshaft and to said first and second shaft means for transferring rotational movement of said crankshaft to said first and second shaft means, timing means associated with said drive means for timing the alignment of said inlet and exhaust passage means of said first and second shaft means with said intake and exhaust openings of said cylinder block and with said intake and exhaust port means of said first and second sleeves, said first and second shaft means being first and second shafts respectively forming intake and exhaust hollows respectively extending along the lengths of said first and second shafts, said intake passage means including said intake hollow and an intake passage formed by said first shaft, said intake hollow having an end portion opening to said source of fuel mixture and said intake passage being capable of being aligned with said intake port means of said first sleeve and said intake opening to said cylinder, a lubricant-fed felt member positioned between said first and second cylindrical sleeves and touching and lubricating each first and second shaft means, said cylinder head members having outer walls, and ribs extending between said outer walls of said cylinder head member and said first and second sleeves; said ribs forming cutout portions, and a cooling fluid passing through said cutout portions between said ribs.

2. A rotary valve system according to claim 1, wherein said first and second shaft means are made of a light-weight material; and support means for stiffening said intake and exhaust passage means.

3. A rotary valve system according to claim 2, wherein said support means includes parallel spaced cross-bars positioned across said intake and exhaust passage means.

4. A rotary valve system according to claim 2, wherein said support means includes flat support members forming a plurality of small holes positioned across said intake and exhaust passage means.

* * * * *